US005533734A

United States Patent [19]

Husk

[11] Patent Number: 5,533,734

[45] Date of Patent: Jul. 9, 1996

[54] WASHER GAME

[76] Inventor: Richard W. Husk, 7020 Savannah Dr., Newburgh, Ind. 47630

[21] Appl. No.: 526,367

[22] Filed: Sep. 11, 1995

[51] Int. Cl.[6] ..... A63B 67/06

[52] U.S. Cl. ..... 273/402

[58] Field of Search ..... 273/398, 400, 273/401, 402

[56] References Cited

U.S. PATENT DOCUMENTS 3,628,793 12/1971 Mudloff ..... 273/402

4,243,229 1/1981 Huser et al. ..... 273/402

5,050,889 9/1991 Walker ..... 273/402

5,201,527 4/1993 Koket ..... 273/402

*Primary Examiner*—William H. Grieb

[57] ABSTRACT

Embodiments of a board and washer game are disclosed, that assembles in such a manner as to provide a means to secure loose game pieces, and for transporting and storage as a unit.

2 Claims, 2 Drawing Sheets

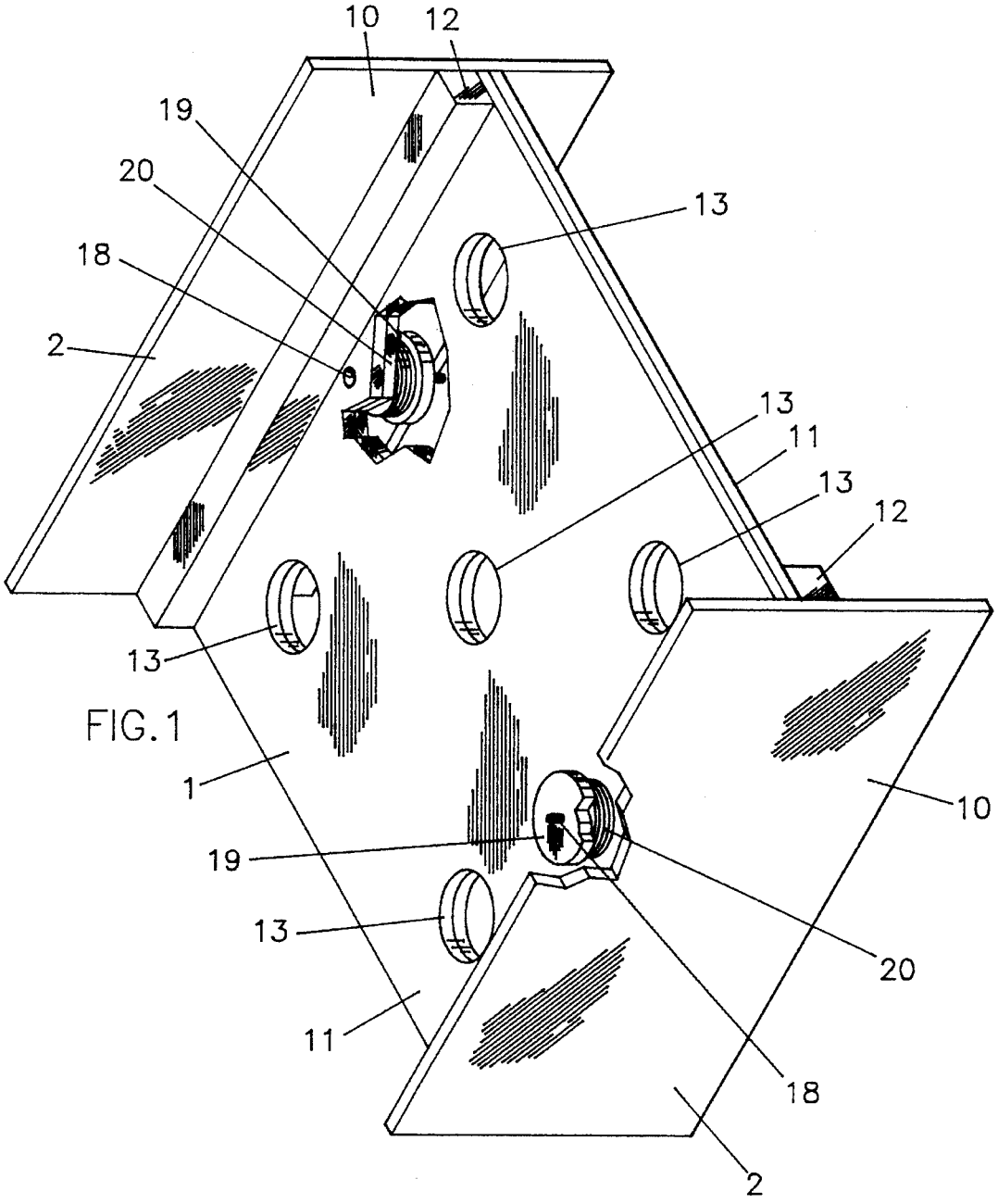
FIG. 1
FIG. 2
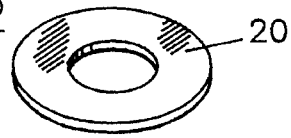

WASHER GAME

INTRODUCTION

This invention relates to a washer game, which includes game boards and steel washers, modified to secure all loose game pieces, and for ease of transport and storage.

Games played with washers, which are thrown at boards, have been popular for some time. Such games are usually homemade, and played in outdoor settings at picnics and family gatherings. Transport and storage of such games are a challenge. Furthermore, when finished playing games that include boards and washers, loose parts are often and easily lost.

The present invention relates to a modification of a game played with boards and washers. An object of the present invention is to provide a game that is simple to design and economical to construct, yet includes a suitable means to secure all its loose game pieces. Another object of the invention is to provide a board and washer game that is convenient to transport and store. These and further objects of the invention will be apparent from the following description of preferred embodiments thereof.

BRIEF SUMMARY OF THE INVENTION

The Washer Game consists of two board assemblies, each board assembly includes a backboard having a plurality of washer clearances where washers are pitched or thrown towards, a board and joist fastened to the backboard in order to hold the backboard in place during play. To prepare for storing, the two board assemblies are fastened together by matching a bolt which protrudes from the board with the bolt clearance on the other board such that the two board assemblies can be attached to form a structure with the washers retained on the said bolt by a cover. Preferably, the bolt is a round head, square neck bolt, and the backboards and boards are fabricated from an exterior grade plywood, finished on one side.

BRIEF DESCRIPTION OF THE DRAWING

The invention is further described in connection with the accompanying drawings, in which:

FIG. 1 is a perspective view of the Washer Game assembled for storage and transport;

FIG. 2 is a perspective view of a washer;

DETAILED DESCRIPTION WITH REFERENCE TO DRAWINGS

Figure 3:
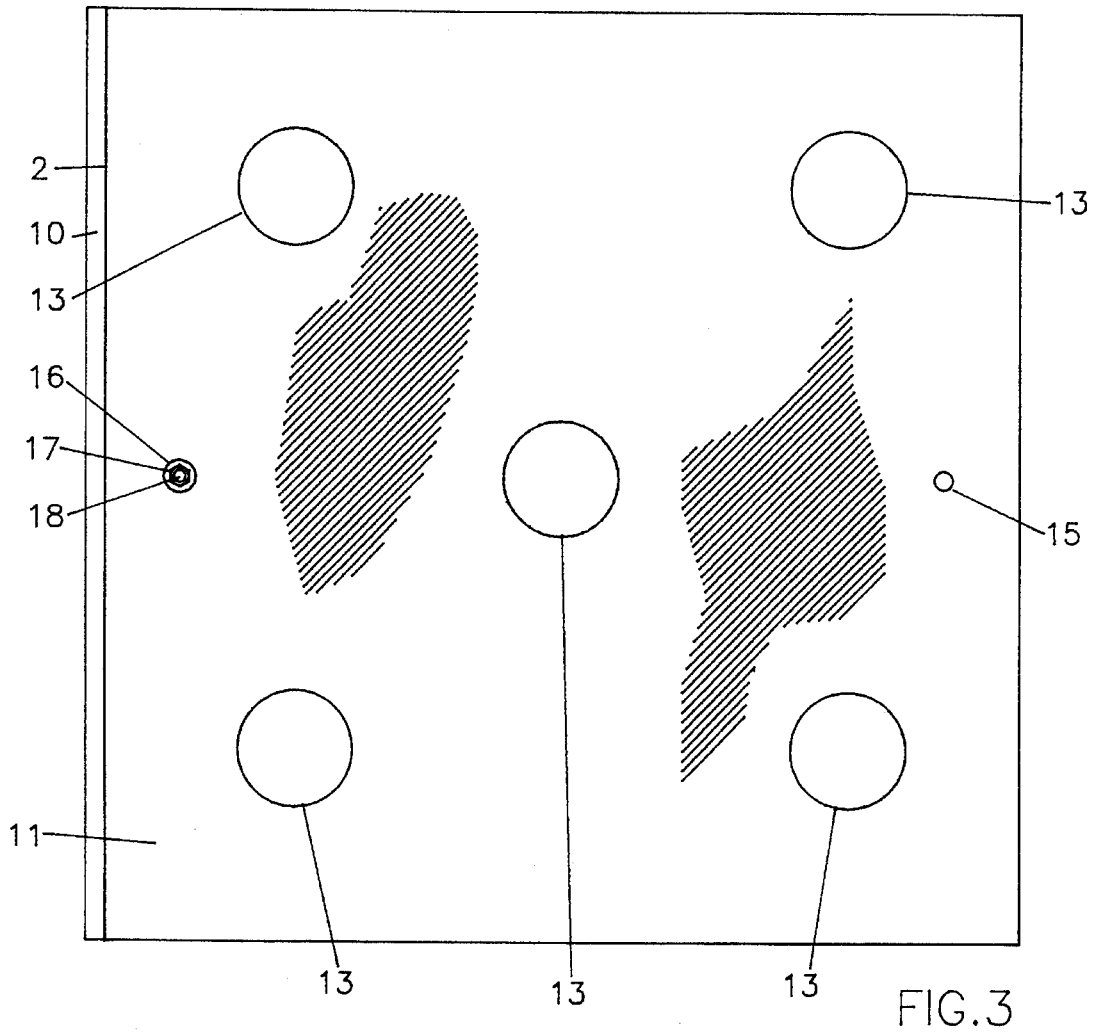
FIG. 3 is a plan view of the board (11) of the Washer Game.

The present invention is the game assembly (1) as shown in Figure (1), and consists of two board assemblies (2), that include each, a backboard (10), a joist (12), and a board (11) within which is a series of washer clearances (13).

FIG. 2 shows a washer (20) which is a steel washer in the preferred embodiment of the invention.

Figure 4:
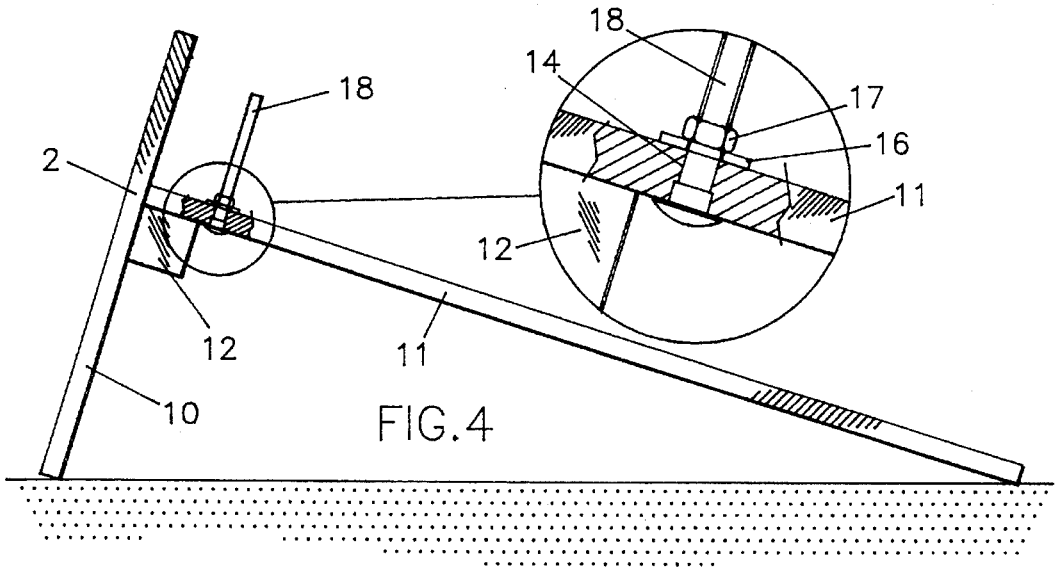
FIG. 4 is a side view of the Washer Game board assembly.

Referring to FIG. 3 which shows a plan view of the board (11) and FIG. 4 which shows a side view of the board assembly (2), it can be seen that the board assembly (2)includes a backboard (10), a board (11), a joist (12), washer clearances (13), an aperture (14), a bolt clearance (15), a small washer (16), a nut (17), and a bolt (18). As shown in FIG. 4, the bolt (18) is inserted through the aperture (14) of the board (11) and secured in place by the small washer (16) and the nut (17). The backboard (10), board (11) and joist (12) are fastened together as a permanent assembly by whatever means convenient and/or available, including nails, screws or adhesive. In the preferred embodiment of the invention, the bolt (18) is a round head square neck bolt as shown in "Fastener Standards" as compiled by the Industrial Fasteners Institute, 1505 East Ohio Building, Cleveland, Ohio 44114, and detailed by the 1970 draft revision of ANSI B18.5 1959. Also, in the preferred embodiment, the backboard (10) and the board (11) are fabricated from an exterior grade plywood, finished on one side. The purpose of the backboard (10) is both to elevate one end of the board (11) above the horizontal plain when the game is being played, and to serve as a backstop to catch the washers (20) that do not fall through the washer clearances (13) when said washers (20) are pitched or thrown towards the washer clearances (13) during play. The joist (12) is fabricated from wood in the preferred embodiment of the invention.

The process of assembling the game assembly (1) as shown in FIG. 1, starts by inverting one board assembly (2) with respect to the second board assembly (2) and fitting the bolt (18) which protrudes from the board (11) with the bolt clearance (15) of the other board (11). The game assembly (1) is attained by attaching the board (11) of each board assembly (2) together as shown in FIG. 1, then setting the washers (20) over and then around each of the bolts (18) which project through each of the matching bolt clearances (15), then adding the covers (19), one for each of the exposed bolts (18). In the preferred embodiment of the present invention, the covers (19) are threaded so they screw onto the bolts (18). The purpose of the covers (19) is to hold the washers (20) in place around the bolts (18). The washer clearances (13) in either of the two board assemblies (2) are inline with washer clearances (13) in the opposite board assembly (2) and serve as a convenient handle during handling and transport.

The game assembly (1) is disassembled by removing the covers (19) from the bolts (18), removing the washers (20) from around the bolts (18), and then separating the two board assemblies (2). Each board assembly (2) is then placed on the ground, or pavement, or floor, with the backboard (10) up-ended in order to elevate one end of said board (11) for play, as shown in FIG. 4.

While preferred embodiments of the invention have been shown and described, it will be apparent to those skilled in this art that various modifications may be made in these embodiments without departing from the spirit of the present invention. Furthermore, while the description above contains many specificities, they should not be construed as limiting the scope of the invention but as merely providing illustrations of some of the presently preferred embodiments of this invention. For that reason, the scope of the invention is set forth in the following claims:

I claim:

1. A board and washer game comprising two game board assemblies, each of said assemblies including:

a first board having a plurality of washer clearance holes, a bolt protruding upwardly from the board surface, and a bolt clearance hole;

a backboard:

a joist connecting said first board and said backboard;

a plurality of washers;

said washers having aperture means to position said washers around said bolts;

whereby said two game board assemblies can be fired together to form a single structure for transport and storage by inserting the bolts of said first and second game board assemblies through the bolt clearance holes of said second and first game board assemblies, respectively.

2. The game of claim 1, further including:

covers to secure said washers in position around said bolts.

* * * * *